US008191192B1

(12) United States Patent
Barker

(10) Patent No.: US 8,191,192 B1
(45) Date of Patent: Jun. 5, 2012

(54) MODULAR TOOLS

(76) Inventor: Richard W. Barker, Glendale, AZ (US)

( * ) Notice: Subject to any disclaimer, the term of this patent is extended or adjusted under 35 U.S.C. 154(b) by 227 days.

(21) Appl. No.: 12/542,630

(22) Filed: Aug. 17, 2009

Related U.S. Application Data

(63) Continuation-in-part of application No. 11/796,093, filed on Apr. 25, 2007, now abandoned.

(60) Provisional application No. 60/745,596, filed on Apr. 25, 2006.

(51) Int. Cl.
*B26B 11/00* (2006.01)

(52) U.S. Cl. ..... 7/160; 7/158

(58) Field of Classification Search ..... 81/160, 81/158; 403/329, 305, 298
See application file for complete search history.

(56) References Cited

U.S. PATENT DOCUMENTS

| | | | |
|---|---|---|---|
| 1,368,944 | A | 2/1921 | Kurose |
| 2,989,807 | A | 6/1961 | Florence |
| 4,635,309 | A | 1/1987 | Larsen |
| 5,127,762 | A | 7/1992 | Havlovitz |
| 5,557,818 | A | 9/1996 | Leon |
| 5,638,566 | A | 6/1997 | Wu |
| 6,142,769 | A | 11/2000 | Walker |
| 6,279,186 | B1 | 8/2001 | Ge et al. |
| D450,086 | S | 11/2001 | Rosenbaum |
| 6,394,677 | B2 | 5/2002 | Wang |
| 6,547,098 | B1 | 4/2003 | Kaye |
| 6,554,163 | B1 | 4/2003 | Kaye |
| 6,557,730 | B1 | 5/2003 | Kaye |
| 6,874,188 | B2 | 4/2005 | Johnson et al. |
| 6,938,345 | B2 | 9/2005 | Yu |
| 7,237,340 | B2 | 7/2007 | Johnson et al. |
| 2003/0028973 | A1 | 2/2003 | Johnson et al. |
| 2003/0066137 | A1 | 4/2003 | Johnson et al. |
| 2003/0145500 | A1 | 8/2003 | Lykens |
| 2004/0231162 | A1 | 11/2004 | Johnson et al. |
| 2005/0138737 | A1 | 6/2005 | Klein |
| 2005/0150116 | A1 | 7/2005 | Johnson et al. |
| 2006/0269276 | A1 | 11/2006 | O'Shea et al. |

FOREIGN PATENT DOCUMENTS

| | | |
|---|---|---|
| GB | 173627 | 1/1922 |

*Primary Examiner* — Debra S Meislin
(74) *Attorney, Agent, or Firm* — Stoneman Law Patent Group; Martin L. Stoneman; Eric Fish

(57) ABSTRACT

A modular tool having a cutting end and a writing end. The cutting end comprises a retractable utility knife. The marking end comprises marker (an ink pen, a highlighter, a marker, or a wax pencil), a pocket clip, and a cap. The cutting end and the writing end are removably rigidly connected, and either end can be modularly replaced. The system includes a kit comprising the tool with replacement blades and multiple markers, and a method of using the modular tool.

19 Claims, 3 Drawing Sheets

MODULAR TOOLS

CROSS-REFERENCE TO RELATED APPLICATION(S)

The present application is a continuation-in-part of related application Ser. No. 11/796,093, filed Apr. 25, 2007, entitled "MODULAR TOOLS", which is now abandoned and claims priority from Prior Provisional Application Ser. No. 60/745,596, filed Apr. 25, 2006, entitled "MODULAR TOOL SYSTEMS", the contents of which are incorporated herein by this reference and are not admitted to be prior art with respect to the present invention by the mention in this cross-reference section.

BACKGROUND

The present invention relates to modular tool systems. More particularly, the present invention relates to modular tool systems useable to open boxes and mark boxes using a handheld implement having modules wherein each module includes at least one tool usable to open boxes or mark boxes.

Multiple tools are often needed for use in a variety of applications (warehouse, automotive, carpentry, electronics, etc.), which sometimes requires users to carry multiple, separate tools. In a warehouse environment, for example, there is a need for a device that is modular and includes multiple tools, such as one tool for marking and one tool for opening boxes. Further, there is a need for a device that enables a user to easily replace one or more modules of the device. Also, there is a need for a kit having a plurality of interchangeable modules, such as modules containing tools, that may be assembled to form a device having a plurality of tools.

No system exists that provides a simple, easy to use, modular tool for marking and opening boxes. Further, no system exists that provides a tool that enables a user to easily replace the marking portion of the tool with a replacement marker. Also, no system exists that provides a kit having a cutting tool having a plurality of interchangeable markers attachable to the cutting tool. In addition, no system exists that enables a user to quickly replace such interchangeable markers using a fast linear attachment motion.

Therefore, a need exists for a simple, easy to use, modular tool for marking and opening boxes. Further, a need exists for a system that provides a tool that enables a user to easily replace the marking portion of the tool with a replacement marker. Also, a need exists for a system that provides a kit having a cutting tool having a plurality of interchangeable markers attachable to the cutting tool. In addition, a need exists for such a system that enables a user to quickly replace such interchangeable markers using a fast linear attachment motion.

OBJECTS AND FEATURES OF THE INVENTION

A primary object and feature of the present invention is to provide modular tool systems.

It is a further object and feature of the present invention to provide such a system that provides a simple, easy to use, modular tool for marking and opening boxes. It is another object and feature of the present invention to provide such a system that provides a tool that permits a user to easily replace the marking portion of the tool with a replacement marker. It is yet another object and feature of the present invention to provide a kit having a cutting tool having a plurality of interchangeable markers attachable to the cutting tool. It is yet another object and feature of the present invention to provide such a system that permits a user to quickly replace such interchangeable markers using a fast linear attachment motion.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a handheld modular tool to cut and mark, such handheld device comprising: a cutter module having a first end and a second end, such cutter module having a cutter retained in such cutter module; a marker module having a first end and a second end and an externally accessible through-aperture in a sidewall of such marker module, such marker module having a marker; a coupling element having a first end, a second end, an interior portion between such first end and second end, such interior portion thicker than such first end and such second end of such coupling element, such second end comprising a spring tab arm extending from such second end of such coupling element and ending in a tab, such first end of such coupling element structured and arranged to linearly slidably engage such second end of such cutter module, without threading or applying torque or twisting to such cutter module, to sheath such first end of such coupling element and wherein such second end of such cutter module abuts such interior portion of such coupling element, such second end of such coupling element structured and arranged to linearly slidably engage such second end of such marker module, without threading or applying torque or twisting to such marker module, to sheath such second end of such coupling element and wherein such second end of such marker module abuts such interior portion of such coupling element, and such tab of such spring tab arm also structured and arranged to engage such externally accessible through-aperture of such marker module and, when engaged, such tab is externally accessible; and wherein such marker module cannot be disengaged from such coupling element until such tab engaged with such externally accessible through-aperture of such marker module is displaced from such externally accessible through-aperture of such marker module. Moreover, it provides such a handheld modular tool wherein such at least one cutter module comprises at least one user-effected linear actuator structured and arranged to actuate such at least one cutter between an extended position and a retracted position relative to such at least one cutter module. Additionally, it provides such a handheld modular tool wherein such cutter comprises a knife blade. Also, it provides such a handheld modular tool wherein such knife blade comprises a snap-off razor blade. In addition, it provides such a handheld modular tool further comprising a cap structured and arranged to engage such first end of such marker module to protect the marker. And, it provides such a handheld modular tool further comprising a connector for attaching such handheld modular tool to an object. Further, it provides such a handheld modular tool wherein such handheld modular tool comprises at least one non-radially symmetrical shape to orient such handheld modular tool in a user's hand.

In accordance with another preferred embodiment hereof, this invention provides a handheld modular tool system having a cutter and a marker, comprising: at least one cutter structured and arranged to cut; at least one marker structured and arranged to mark; at least one cutter handle structured and arranged to handle such at least one cutter, wherein such at least one cutter handle comprises at least one blade end and at least one first connector end; at least one marker handle structured and arranged to handle such at least one marker, wherein such at least one marker handle comprises at least one marker end and at least one second connector end; at least one coupler structured and arranged to rigidly linearly couple, without threading or applying torque or twisting, such at least one first connector end to such at least one second connector end; and at least one releaser structured and arranged to release such at least one coupler. Even further, it provides such a handheld modular tool system further comprising at least one user-effected linear actuator structured and arranged to actuate such at least one cutter between an extended position and a retracted position relative to such at least one cutter handle. Moreover, it provides such a handheld modular tool wherein such cutter comprises a knife blade. Additionally, it provides such a handheld modular tool system, wherein such at least one cutter comprises at least one snap-off razor blade. Also, it provides such a handheld modular tool system, wherein such at least one cutter handle comprises at least one cutter replacer structured and arranged to assist replacement of such at least one cutter. In addition, it provides such a handheld modular tool system, further comprising at least one clip structured and arranged to assist in clipping such modular tool system to at least one object. And, it provides such a handheld modular tool system, further comprising at least one cap structured and arranged to cap such at least one marker. Further, it provides such a handheld modular tool system, wherein such at least one coupler comprises at least one friction-fit coupler. Even further, it provides such a handheld modular tool system, wherein such at least one cutter handle comprises at least one spring-tab structured and arranged to couple with at least one recess, and wherein such at least one marker handle comprises at least one recess structured and arranged to couple with at least one spring-tab. Even further, it provides such a handheld modular tool system, wherein such at least one cutter handle comprises at least one orienter structured and arranged to assist in orienting such at least one cutter in at least one user's hand, and such at least one marker handle comprises at least one orienter structured and arranged to assist in orienting such at least one marker in at least one user's hand.

In accordance with another preferred embodiment hereof, this invention provides a handheld modular tool system, relating to opening and marking boxes, comprising: at least one modular tool comprising at least one first cutter structured and arranged to cut; at least one first marker structured and arranged to mark; at least one cutter handle structured and arranged to handle such at least one first cutter, wherein such at least one cutter handle comprises at least one blade end and at least one first connector end; at least one marker handle structured and arranged to handle such at least one first marker, wherein such at least one marker handle comprises at least one marker end and at least one second connector end; at least one coupler structured and arranged to rigidly linearly couple, without threading or applying torque or twisting, such at least one first connector end to such at least one second connector end; and at least one releaser structured and arranged to release such at least one coupler; at least one second marker structured and arranged to mark; wherein such at least one first marker and such at least one second marker are interchangeable; and at least one enclosure structured and arranged to enclose such at least one tool and such at least one second marker. Even further, it provides such a handheld modular tool system, wherein such at least one first marker comprises one of at least one ink marker, at least one highlighter, at least one crayon, or at least one ink pen; and such at least one second marker comprises one of at least one ink marker, at least one highlighter, at least one crayon, or at least one ink pen. Even further, it provides such a handheld modular tool kit, further comprising at least one second cutter structured and arranged to cut wherein such at least one first cutter and such at least one second cutter are interchangeable.

In accordance with a preferred embodiment hereof, this invention provides a modular warehouse tool system, relating to opening and mark boxes, comprising: at least one cutter structured and arranged to cut; at least one marker structured and arranged to mark; at least one cutter handle structured and arranged to handle such at least one cutter; wherein such at least one cutter handle comprises at least one blade end and at least one first connector end; at least one marker handle structured and arranged to handle such at least one marker; wherein such at least one marker handle comprises at least one marker end and at least one second connector end; at least one coupler structured and arranged to rigidly linearly couple such at least one first connector end to such at least one second connector end; and at least one releaser structured and arranged to release such at least one coupler.

Moreover, it provides such a modular warehouse tool system, further comprising at least one retractor structured and arranged to retract such at least one cutter relative to such at least one cutter handle. Additionally, it provides such a modular warehouse tool system, wherein such at least one retractor comprises at least one selectable retractor structured and arranged to selectably retract such at least one cutter relative to such at least one cutter handle. Also, it provides such a modular warehouse tool system, wherein such at least one cutter comprises at least one razor blade. In addition, it provides such a modular warehouse tool system, wherein such at least one cutter comprises at least one snap-off razor blade. And, it provides such a modular warehouse tool system, wherein such at least one cutter handle comprises at least one cutter replacer structured and arranged to assist replacement of such at least one cutter.

Further, it provides such a modular warehouse tool system, further comprising at least one clip structured and arranged to clip such modular warehouse tool system to at least one object. Even further, it provides such a modular warehouse tool system, wherein such clip comprises at least one handle clip structured and arranged to clip such at least one marker handle to at least one object. Moreover, it provides such a modular warehouse tool system, further comprising at least one cap structured and arranged to cap such at least one marker. Additionally, it provides such a modular warehouse tool system, wherein such at least one coupler comprises at least one friction-fit coupler. Also, it provides such a modular warehouse tool system, wherein such at least one coupler comprises at least one spring-tab-and-recess coupler. In addition, it provides such a modular warehouse tool system, wherein such at least one cutter handle comprises at least one spring-tab structured and arranged to couple with at least one recess. And, it provides such a modular warehouse tool system, wherein such at least one marker handle comprises at least one recess structured and arranged to couple with at least one spring-tab.

Further, it provides such a modular warehouse tool system, wherein such at least one cutter handle comprises at least one orienter structured and arranged to orient such at least one cutter in at least one user's hand. Even further, it provides such a modular warehouse tool system, wherein such at least one marker handle comprises at least one orienter structured and arranged to orient such at least one marker in at least one user's hand.

In accordance with another preferred embodiment hereof, this invention provides a modular warehouse tool kit, relating to opening and mark boxes, comprising: at least one modular warehouse tool comprising at least one first cutter structured and arranged to cut; at least one first marker structured and arranged to mark; at least one cutter handle structured and arranged to handle such at least one first cutter; wherein such at least one cutter handle comprises at least one blade end and at least one first connector end; at least one marker handle structured and arranged to handle such at least one first marker; wherein such at least one marker handle comprises at least one marker end and at least one second connector end; at least one coupler structured and arranged to rigidly linearly couple such at least one first connector end to such at least one second connector end; and at least one releaser structured and arranged to release such at least one coupler; at least one second marker structured and arranged to mark; wherein such at least one first marker and such at least one second marker are interchangeable; and at least one consumer packaging structured and arranged to package such at least one tool and such at least one second marker.

Moreover, it provides such a warehouse kit, wherein such at least one first marker is selected from the group essentially consisting of: at least one ink marker, at least one highlighter, at least one crayon, and at least one ink pen. Additionally, it provides such a warehouse kit, wherein such at least one second marker is selected from the group essentially consisting of: at least one ink marker, at least one highlighter, at least one crayon, and at least one ink pen. Also, it provides such a warehouse kit, further comprising at least one second cutter structured and arranged to cut wherein such at least one first cutter and such at least one second cutter are interchangeable.

In accordance with another preferred embodiment hereof, this invention provides a warehouse method, relating to opening and marking boxes with at least one modular warehouse tool, comprising the steps of: providing at least one cutter; providing a plurality of markers; wherein such at least one cutter is releasably linearly coupleable to each of such plurality of markers; selecting exactly one of such plurality of markers; linearly coupling such selected marker to such at least one cutter; and using either such at least one cutter or such selected marker. In addition, it provides such a warehouse method, further comprising the step of removing such selected marker; selecting exactly one second marker of such plurality of markers; and linearly coupling such second selected marker to such at least one cutter. And, it provides such a warehouse method, further comprising the step of replacing such at least one cutter.

In accordance with another preferred embodiment hereof, this invention provides a modular warehouse tool system, relating to opening and marking boxes, comprising: cutter means for cutting; marker means for marking; cutter handle means for handling such cutter means; wherein such cutter handle means comprises at least one blade end and at least one first connector end; marker handle means for handling such marker means; wherein such marker handle means comprises at least one marker end and at least one second connector end; coupler means for rigidly linearly coupling such first connector end to such second connector end; and releaser means for releasing such coupler means.

Further, it provides such a modular warehouse tool system, further comprising retractor means for retracting such cutter means relative to such cutter handle means. Even further, it provides such a modular warehouse tool system, wherein such retractor means comprises selectable retractor means for selectably retracting such cutter means relative to such cutter handle means. Even further, it provides such a modular warehouse tool system, wherein such cutter handle means comprises cutter replacement means for replacing such cutter means. Even further, it provides such a modular warehouse tool system, further comprising clip means for clipping such modular warehouse tool system to at least one object. Even further, it provides such a modular warehouse tool system, wherein such clip means comprises handle clip means for clipping such marker handle means to at least one object.

Even further, it provides such a modular warehouse tool system, further comprising cap means for capping such marker means. Even further, it provides such a modular warehouse tool system, wherein such cutter handle means comprises orienter means for orienting such cutter means in at least one user's hand. Even further, it provides such a modular warehouse tool system, wherein such marker handle means comprises orienter means for orienting such marker means in at least one user's hand.

DETAILED DESCRIPTION OF THE BEST MODES AND PREFERRED EMBODIMENTS OF THE INVENTION

Figures 1, 2, 3:
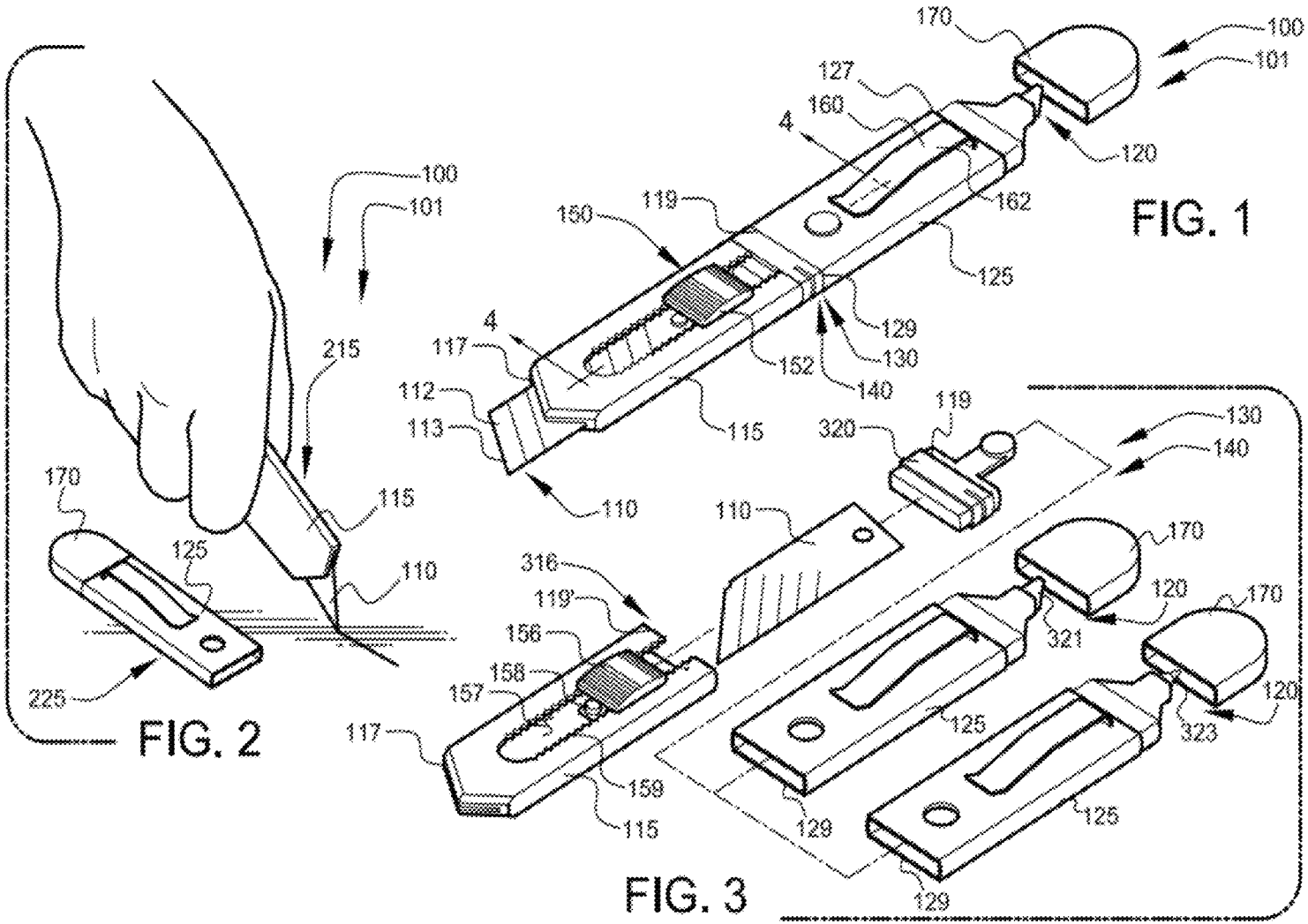
FIG. 1 shows a perspective view illustrating a modular tool according to a preferred embodiment of the present invention.
FIG. 2 shows a perspective view illustrating the modular tool according to FIG. 1 in use.
FIG. 3 shows an exploded perspective view, illustrating the assembly of the modular tool according to the preferred embodiment of FIG. 1.

FIG. 1 shows a perspective view illustrating a modular tool according to a preferred embodiment of the present invention. Preferably, modular tool system 100 (also referred to herein as a modular warehouse tool system) comprises modular tool 101, as shown. Modular tool 101 is preferably hand-holdable, as shown. Modular tool 101 is preferably used to open and/or mark items (such as boxes).

Preferably, modular tool 101 comprises at least one cutter 110 and at least one marker 120, as shown. Preferably, cutter 110 and marker 120 are positioned on opposite ends of modular tool 101 so that a user may reverse modular tool 101 to access the function of the other tool. Modular tool 101 is preferably about eight inches in length and has a preferred width between about one inch and about two-and-one-half inches.

Preferably, modular tool 101 comprises at least one cutter module 115 (also referred to herein as a "cutter handle") structured and arranged to retain cutter 110, as shown. Modular tool 101 also preferably comprises at least one marker module 125 (also referred to herein as a "marker handle") structured and arranged to retain marker 120, as shown. Modular tool 101 preferably comprises at least one coupler 130 structured and arranged to rigidly linearly couple cutter module 115 to marker module 125, as shown.

Cutter module 115 preferably comprises at least one blade end 117 and at least one marker-module connecting end 119, as shown. Cutter module 115 also preferably comprises coupler-connecting end 119' (to facilitate connection with coupler 130), as shown.

Marker module 125 preferably comprises at least one marker end 127 and at least one coupler-receiving end 129, as shown.

Further, modular tool 101 preferably comprises at least one releaser 140 structured and arranged to release marker module 125 from cutter module 115 (comprising coupler 130), as shown. A user preferably activates release to replace modules from time to time.

As stated above, cutter module 115 preferably comprises at least one blade end 117 and marker-module connecting end 119, as shown. Preferably, blade end 117 of cutter module 115 comprises an aperture for deploying and retracting cutter 110 in cutter module 115, as shown. Preferably, coupler-connecting end 119' couples the cutter portion of cutter module 115 with coupler 130, as shown. It is noted that for purposes of discussion herein, cutter module 115 includes the structure referred to as coupler 130. In use, marker module 125 is removed by a user from time to time (when desired). When removed, cutter module 115 preferably retains coupler 130 (via a friction fit with cutter portion of cutter module 115). Coupler 130 may preferably be removed from the cutter portion of cutter module 115 exposing coupler-connecting end 119' when, for example, cutter 110 is to be replaced when dull, broken, etc.

Preferably, marker module 125 comprises at least one marker end 127 and at least one coupler-receiving end 129, as shown. Preferably, marker end 127 of marker module 125 comprises marker 120, as shown. Preferably, coupler-receiving end 129 couples marker module 125 with coupler 130, as shown.

Upon reading the teachings of this specification, those with ordinary skill in the art will now understand that, under appropriate circumstances, considering such issues as advances in technology, user preference, etc., other modular tool components, such as safety features, a plurality of markers, storage of other markers, a plurality of cutters, storage of other cutters, lanyards, lights, bar code scanners, optical character readers, digital cameras, digital clocks, data storage devices, computer processors, laser pointers, etc., may suffice.

Preferably, modular tool 101 further comprises at least one linear actuator 150 structured and arranged to extend and retract cutter 110 relative to cutter module 115, as shown. More particularly, cutter module 115 comprises actuator 150, as shown. Preferably, actuator 150 is user-effected such that a user may selectably extend or retract cutter 110. Preferably, cutter 110 is extended and retracted in a linear manner.

Preferably, actuator 150 comprises slider 156 (comprising connector 158) and groove 157. Preferably, cutter 110 connects to slider 156 via connector 158, as shown. Preferably, slider 156 slides along groove 157, causing cutter 110 to slide within cutter module 115. Preferably, actuator 150 slidingly extends and retracts cutter 110 in and out of blade end 117 (via an aperture) of cutter module 115 in response to pressure from a user.

Preferably, actuator 150 comprises at least one selectable retractor 152 structured and arranged to selectably retract cutter 110 relative to cutter module 115, as shown. Preferably, selectable retractor 152 slidingly extends and retracts cutter 110 incrementally in and out of blade end 117 of cutter module 115 in response to pressure from the user. Preferably, in selectable retractor 152, groove 157 comprises ridged groove 159, as shown. Preferably, ridged groove 159 provides incremental locking positions for slider 156. Upon reading the teachings of this specification, those with ordinary skill in the art will now understand that, under appropriate circumstances, considering such issues as advances in technology, user preference, etc., other retractors, such as automatic retractors, voice-activated retractors, etc., may suffice. Actuator 150 preferably extends cutter 110 to any suitable distance from the modular tool 101. Preferably, cutter 110 may extend the cutter preferably a one-half inch or more, preferably one inch or more, from cutter module 115.

Preferably, cutter 110 comprises at least one knife blade, preferably at least one razor blade 112, as shown. Preferably, razor blade 112 comprises at least one utility blade such as the utility blades manufactured by Martor USA, of Green Bay, Wis. Preferably, razor blade 112 comprises snap-off razor blade 113, as shown. Preferably, cutter 110 comprises at least one snap-off razor blade 113, as shown. Preferably, snap-off razor blade 113 comprises at least one snap-off utility blade manufactured by Martor USA, of Green Bay, Wis. Upon reading the teachings of this specification, those with ordinary skill in the art will now understand that, under appropriate circumstances, considering such issues as advances in technology, user preference, etc., other cutters, such as blunt tape slitters, laser cutters, hot cutters, vibrating cutters, ultrasonic cutters, scissors, etc., may suffice.

Preferably, modular tool 101 further comprises at least one clip 160 structured and arranged to clip or connect modular tool 101 to at least one object, such as a user's pocket. Preferably, clip 160 comprises at least one handle clip 162 structured and arranged to clip marker module 125 to at least one object, as shown, such as a user's pocket, a clipboard, or other desired object. Preferably, clip 160 comprises at least one metal and/or plastic spring-clip structured and arranged to clip onto a pocket, clipboard, etc. Upon reading the teachings of this specification, those with ordinary skill in the art will now understand that, under appropriate circumstances, considering such issues as advances in technology, user preference, etc., other warehouse tool retainers, such as magnets, lanyards, wrist straps, other clip placements, other types of clips, etc., may suffice.

Preferably, modular tool 101 further comprises at least one cap 170 structured and arranged to cap marker 120, as shown. Preferably, cap 170 protects marker 120 when marker 120 is not being used, as shown. Preferably, cap 170 engages marker end 127 by a friction-fit. Upon reading the teachings of this specification, those with ordinary skill in the art will now understand that, under appropriate circumstances, considering such issues as advances in technology, user preference, etc., other cap arrangements, such as screw-on caps, caps that post over the cutter end when the marker is in use, retractable markers, no cap, etc., may suffice.

Preferably, modular tool 101 may comprise a connector such as a magnet (not shown) (preferably in addition to or preferably in place of clip 160) attached to the device (such as to cap 170 or elsewhere [cutter module 115 and/or marker module 125 or any other component of modular tool 101]) that then can be magnetically attached to another object. In one embodiment, the object is a lanyard, such as a cord or chain worn around a user's neck, and the magnet on the device attaches to a magnet on the lanyard. Hook and loop fasteners may also be preferably used to attach device 101 to an object.

Cap 170 may include any other desired features. In one embodiment of the present invention, for example, the cap 170 comprises a magnet to magnetically attach to other objects. The magnet may be embedded in the cap 170 and may connect to any other suitable objects, such as a lanyard having a magnet to allow the modular tool to be worn around the neck of a user. Cap 170 (or the modular tool itself) can thus be releasably connected to the lanyard for carrying and easy access.

FIG. 2 shows a perspective view illustrating modular tool 101 according to FIG. 1, in use. Preferably, cutter module 115 comprises at least one orienter 215 structured and arranged to orient cutter 110 in the user's hand, as shown. Preferably, orienter 215 enables the user to predict the orientation of cutter 110 by feeling the shape of cutter module 115, as shown. Preferably, orienter 215 comprises at least one non-radially symmetrical shape of cutter module 115, as shown. Preferably, cutter module 115 comprises at least one rectangular cross-section, as shown. Upon reading the teachings of this specification, those with ordinary skill in the art will now understand that, under appropriate circumstances, considering such issues as advances in technology, user preference, etc., other handle shapes, such as round handles, square handles, ergonomically shaped handles, one handle with a cutter and modularly replaceable markers on opposite ends, etc., may suffice.

Preferably, marker module 125 comprises at least one orienter 225 structured and arranged to orient marker 120 in the user's hand, as shown. Preferably, orienter 225 (at least embodying herein wherein such at least one marker handle comprises at least one orienter structured and arranged to orient such at least one marker in at least one user's hand) permits the user to predict the orientation of marker 120 by feeling the shape of marker module 125. Preferably, orienter 225 comprises at least one non-radially symmetrical shape of marker module 125, as shown. Preferably, marker module 125 comprises at least one rectangular cross-section, as shown. Upon reading the teachings of this specification, those with ordinary skill in the art will now understand that, under appropriate circumstances, considering such issues as advances in technology, user preference, etc., other handle shapes, such as round handles, square handles, ergonomically shaped handles, one handle with a marker and modularly replaceable cutters on opposite ends, etc., may suffice.

Preferably, cutter 110 and marker 120 are independently operable when disconnected from each other, as shown. Preferably, modular tool 101 is used with cutter 110 and marker 120 connected together, as shown in FIG. 1. This permits users to conveniently open and mark boxes without switching tools, resulting in time savings.

FIG. 3 shows an exploded perspective view, illustrating the assembly of modular tool 101 according to the preferred embodiment of FIG. 1. Preferably, cutter module 115 comprises at least one cutter replacer 316 structured and arranged to assist replacement of cutter 110, as shown. Preferably, cutter replacer 316 comprises removable stopper 320, as shown. Preferably, removing removable stopper 320 provides access to cutter 110, as shown, so that cutter 110 can be removed and replaced. Preferably, removable stopper 320 friction-fits into cutter module 115, as shown. Preferably, removable stopper 320 comprises marker-module connecting end 119, as shown. Upon reading the teachings of this specification, those with ordinary skill in the art will now understand that, under appropriate circumstances, considering such issues as advances in technology, user preference, etc., other replacers, such as side-opening cutter handles, automatic blade replacement, etc., may suffice.

Preferably, cutter 110 is installed in cutter module 115, as shown. Preferably, removable stopper 320 is inserted into cutter module 115, as shown. Preferably, cutter 110 substantially rigidly and linearly couples with marker 120 via coupler 130, as shown. Preferably, coupler-receiving end 129 of marker module 125 substantially rigidly couples with marker-module connecting end 119 of cutter module 115, as shown. Preferably, coupler-receiving end 129 of marker module 125 couples with marker-module connecting end 119 of cutter module 115 to form a substantially linear modular tool 101, as shown. Preferably, for the purposes of the present patent application, the term "linearly coupled" means coupling performed via linear motion, without torque, threaded connectors, or other twisting motion.

Figure 5:
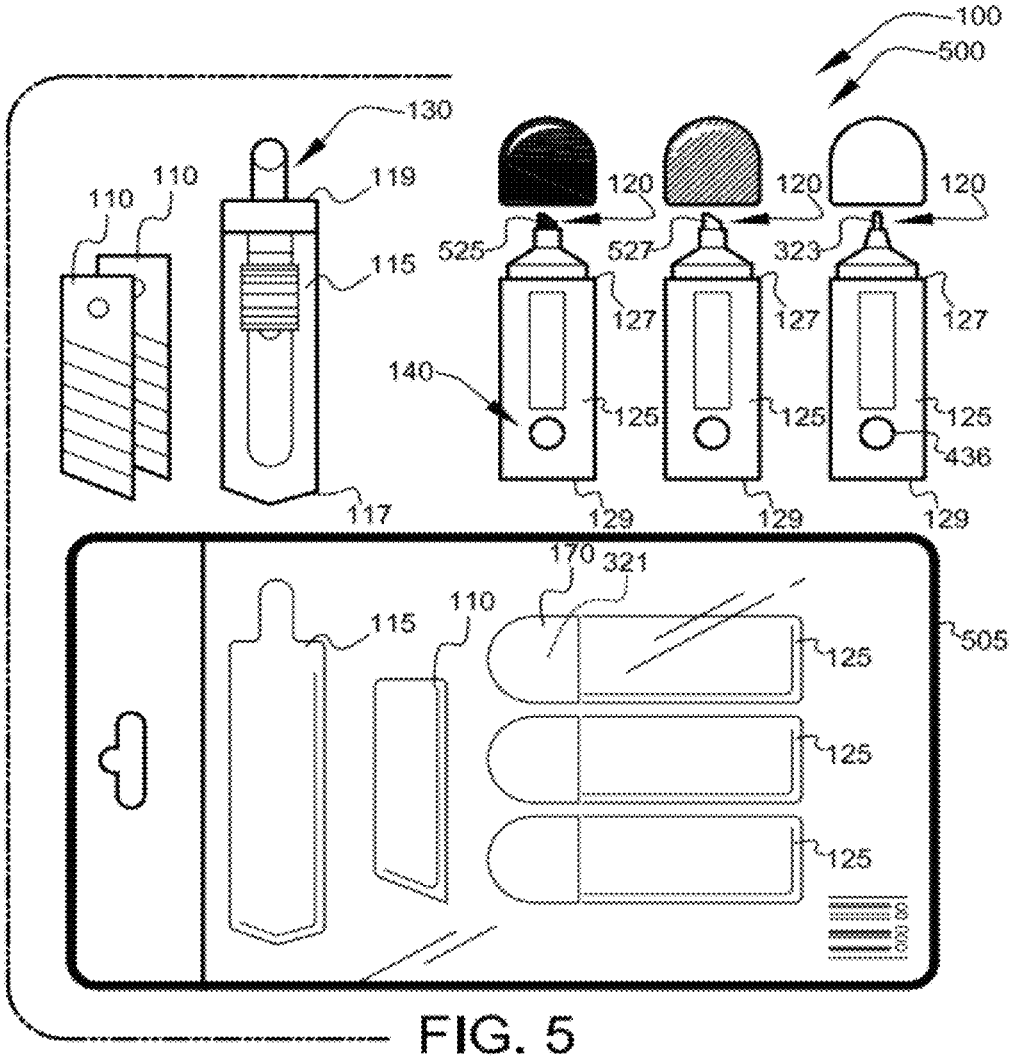
FIG. 5 shows a top view illustrating a kit according to another preferred embodiment of the present invention.

Preferably, marker 120 comprises crayon 321, as shown. Preferably, crayon 321 is structured and arranged to write on smooth surfaces such as plastic. Crayons 321 are also known as grease pencils, wax pencils, or china markers. Preferably, crayons 321 may be manufactured for use with modular tool 101 in a plurality of colors. Preferably, marker 120 comprises ink pen 323, as shown. Preferably, ink pens 323 may be manufactured for use with modular tool 101 in a plurality of colors. Preferably, ink pens 323 comprise at least one of ball point pens, roller ball pens, gel pens, felt-tip pens, etc. Preferably, marker 120 comprises ink marker 525 (as shown in FIG. 5), as shown. Preferably, ink markers 525 may be manufactured for use with modular tool 101 in a plurality of substantially opaque colors. Preferably, ink markers 525 comprise a large fiber tip for writing, as shown. Preferably, marker 120 comprises highlighter 527 (as shown in FIG. 5). Preferably, highlighters 527 may be manufactured for use with modular tool 101 in a plurality of substantially transparent colors. Preferably, highlighter 527 comprises a large fiber tip for writing. Upon reading the teachings of this specification, those with ordinary skill in the art will now understand that, under appropriate circumstances, considering such issues as advances in technology, user preference, etc., other marking tools, such as a stylus, a mini-printer, a paintbrush, watercolor sticks, engraver, tattoo needle, wood burner, etc., may suffice.

Preferably, coupler 130 connects modules of modular tool 101 together. Coupler 130 preferably comprises at least one cutter-module end 403 and at least one marker-module end 432, as shown. Coupler 130 preferably comprises interior portion 406 between cutter-module end 403 and marker-module end 432, as shown. Interior portion 406 is preferably thicker (or raised) when compared with cutter-module end 403 marker-module end 432, as shown. Preferably, when marker module 125 and cutter module 115 are connected to coupler, the ends of the modules abut interior portion 406, as shown.

Coupler further comprise spring-tab arm which preferably extends away from marker-module end 432 of coupler 130 ending in spring-tab 435, as shown.

Coupler 130 preferably engages marker module 125 at coupler-receiving end 129 via a friction fit, as shown.

Preferably, coupler 130 comprises releaser 140, as shown. Preferably, releaser 140 permits the user to disconnect cutter module 115 from a particular marker module 125 comprising a particular marker 120 (such as crayon 321), as shown. Preferably, after cutter module 115 has been released from marker module 125, cutter module 115 can be coupled to a different marker module 125 comprising a different marker 120 (such as ink pen 323), as shown. Additionally preferably, the modules may be uncoupled and then coupled to any other desired module having a tool, such as a cutter, marker, flashlight, screwdriver, etc., or the modules may simply be uncoupled and replaced when the usable life of the respective tool has expired.

Preferably, cutter module 115 (which holds cutter 110), and marker module 125 (which holds marker 120) are independently replaceable modular components of modular tool 101, as shown. Preferably, cutter 110 (at least embodying herein cutter means for cutting) is an independently replaceable modular component of modular tool 101, as shown. Preferably, cap 170 is an independently replaceable modular component of modular tool 101, as shown.

Figure 4:
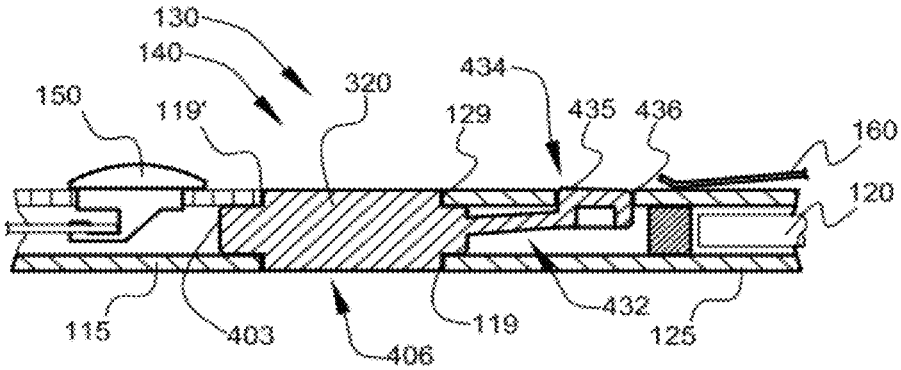
FIG. 4 shows sectional view 4-4 of FIG. 1.

FIG. 4 shows sectional view 4-4 of FIG. 1. Preferably, coupler 130 connects to marker module 125 securely, as shown. Preferably, coupler 130 connects to marker module 125 by friction fit, as shown. Preferably, coupler 130 linearly engages marker module 125 without threading or applying torque or twisting to marker module 125 and with a friction fit between coupler-receiving end 129 of marker module 125 and marker-module connecting end 119 of cutter module 115, as shown. Preferably, coupler-receiving end 129 of marker module 125 sheathes marker-module connecting end 119 of cutter module 115, as shown.

Additionally, for secure coupling, coupler 130 preferably comprises at least one spring-tab-and-recess coupler 434, as shown. Preferably, spring-tab-and-recess coupler 434 comprises at least one spring-tab 435 and at least one recess 436, as shown. Marker module 125 preferably comprises recess 436, as shown. Recess 436 is preferably an externally accessible through-aperture in a sidewall of marker module 125, as shown. Preferably, spring-tab 435 resiliently engages recess 436, as shown. Preferably, cutter module 115 comprises spring-tab 435, as shown. Preferably, cutter module 115 and marker module 125 are pressed together whereby spring-tab 435 aligns with and engages recess 436, as shown. It is noted that cutter module 115 and marker module 125 cannot be disengaged from one another until spring-tab 435 displaced from recess 436. This advantageously permits a user to cut and write with force without worry that the modules will come apart accidentally.

Preferably, cutter module 115 and marker module 125 are separated by pressing spring-tab 435 to disengage spring-tab 435 from recess 436 and then pulling cutter module 115 and marker module 125 apart. Preferably, coupler 130 comprises releaser 140, as shown. Upon reading the teachings of this specification, those with ordinary skill in the art will now understand that, under appropriate circumstances, considering such issues as advances in technology, user preference, etc., other couplers, such as only friction coupling, snap coupling, magnetic coupling, temporary adhesive coupling, connections requiring rotation less than one hundred eighty degrees, the spring-tab-and-recess coupler structured and arranged to function in multiple marker handle orientations, etc., may suffice.

Additionally, cutter module 115 preferably has a cutter portion connected to coupler 130 by friction fit. More specifically, coupler-connecting end 119' of cutter module 115 linearly connects to cutter-module end 403 preferably without threading or applying torque or twisting to said cutter module and preferably with a friction fit. Once connected, cutter portion of cutter module 115 sheathes cutter-module end 403 of coupler 130, as shown.

FIG. 5 shows a top view illustrating kit 500 (also referred to herein as a modular warehouse tool kit) according to another preferred embodiment of the present invention. Preferably, modular warehouse system 100 comprises kit 500, as shown.

Preferably, kit 500 comprises at least one modular tool 101 comprising at least one first cutter 110; at least one first marker 120; at least one cutter module 115 structured and arranged to handle first cutter 110; wherein cutter module 115 comprises at least one blade end 117 and marker-module connecting end 119; at least one marker module 125 structured and arranged to retain first marker 120; wherein marker module 125 comprises at least one marker end 127 and at least one coupler-receiving end 129; at least one coupler 130 structured and arranged to rigidly linearly couple marker-module connecting end 119 of cutter module 115 to coupler-receiving end 129 of marker module 125; at least one releaser 140 structured and arranged to release coupler 130; at least one second marker 120; wherein first marker 120 and second marker 120 are interchangeable; and at least one consumer packaging 505 structured and arranged to package modular tool 101 and second marker 120, as shown.

Preferably, such at least one first marker 120 is preferably at least one ink marker 525, at least one highlighter 527, at least one crayon 321, and at least one ink pen 323, as shown. Preferably, such at least one second marker 120 is also preferably at least one ink marker 525, at least one highlighter 527, at least one crayon 321, and at least one ink pen 323, as shown. Preferably, the user selects first marker 120 and second marker 120 according to their preference.

Preferably, kit 500 further comprises at least one second cutter 110 wherein first cutter 110 and second cutter 110 are interchangeable, as shown. Preferably, first cutter 110 is replaced with second cutter 110 when first cutter 110 becomes dull, damaged, etc. Upon reading the teachings of this specification, those with ordinary skill in the art will now understand that, under appropriate circumstances, considering such issues as advances in technology, user preference, etc., other kit components, such as instructions, multiple colors of the same type of marker, multiple colors of handles, etc., may suffice.

Preferably, modular tool system 100 also comprises at least one flashlight (not shown) retained in a flashlight module (similar to cutter module 115 or marker module 125) according to another preferred embodiment of the present invention. In such embodiment, the flashlight module preferably allows any portion of the flashlight to be replaced, such as the bulb and/or battery. The flashlight may have any suitable dimensions and may include a switch to activate and deactivate the flashlight, such as a push-button switch or slide switch.

Figure 6:
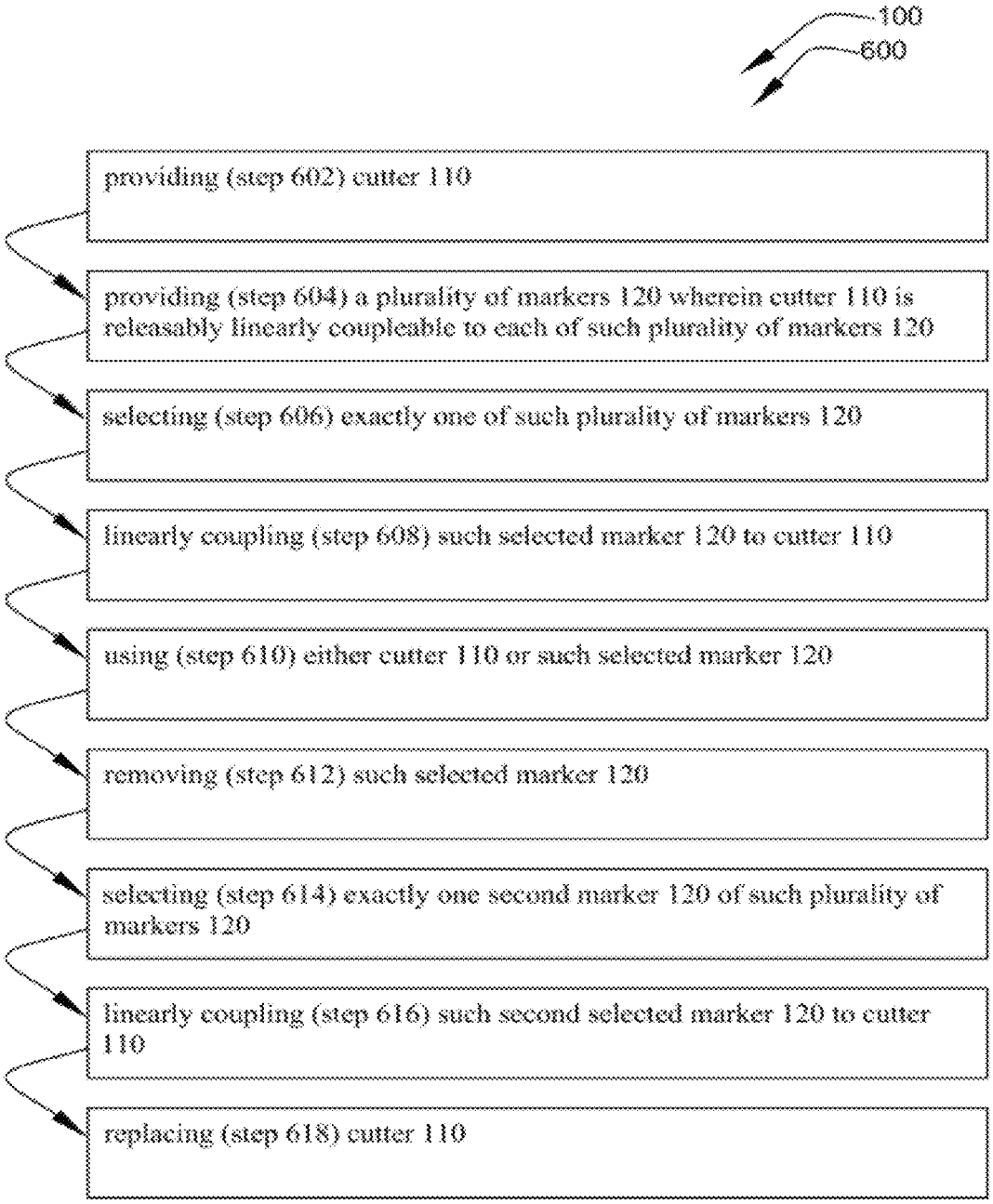
FIG. 6 shows a diagram illustrating a method according to another preferred embodiment of the present invention.

FIG. 6 shows a diagram illustrating method 600 according to another preferred embodiment of the present invention.

Preferably, modular warehouse system 100 comprises method 600, as shown. Preferably, method 600 comprises the steps of: providing (step 602) cutter 110 (preferably mounted in cutter handles 115); providing (step 604) a plurality of markers 120 (preferably mounted in marker handles 125) wherein cutter 110 is releasably linearly coupleable to each of such plurality of markers 120 (as shown in FIG. 3); selecting (step 606) exactly one of such plurality of markers 120; linearly coupling (step 608) such selected marker 120 to cutter 110 (as shown in FIG. 3); and using (step 610) either cutter 110 or such selected marker 120, as shown (at least embodying herein the step of providing at least one cutter; and at least embodying herein the step of providing a plurality of markers wherein such at least one cutter is releasably linearly coupleable to each of such plurality of markers; and at least embodying herein the step of selecting exactly one of such plurality of markers; and at least embodying herein the step of linearly coupling such selected marker to such at least one cutter; and at least embodying herein the step of using either such at least one cutter or such selected marker).

Preferably, method 600 further comprises the steps of removing (step 612) such selected marker 120; selecting (step 614) exactly one second marker 120 of such plurality of markers 120; and linearly coupling (step 616) such second selected marker 120 to cutter 110, as shown (at least embodying herein the step of removing such selected marker; at least embodying herein the step of selecting exactly one second marker of such plurality of markers; and at least embodying herein the step of linearly coupling such second selected marker to such at least one cutter). Preferably, method 600 further comprises the step of replacing (step 618) cutter 110, as shown (at least embodying herein the step of replacing such at least one cutter). Upon reading the teachings of this specification, those with ordinary skill in the art will now understand that, under appropriate circumstances, considering such issues as advances in technology, user preference, etc., other method steps, such as purchasing replacement parts, selling modular tools, selling custom warehouse tool kits, custom imprinting the modular tools, etc., may suffice.

Upon reading the teachings of this specification, those with ordinary skill in the art will now understand that, under appropriate circumstances, considering such issues as cost, user applications, etc., other tools for use with the modular tools system, such as a wrench, screwdriver, pliers, hammer, optical device (such as a magnifying glass), power tool (such as a drill or saw), air tool, electrical tool, a flashlight, laser pointer, diagnostic equipment, tool that interfaces with an external system, such as a power source, etc., may suffice.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A handheld modular tool to cut and mark, said handheld device comprising:

a) a cutter module having a first end and a second end, said cutter module having a cutter retained in said cutter module;

b) a marker module having a first end and a second end and an externally accessible through-aperture in a sidewall of said marker module, said marker module having a marker;

c) a coupling element having i) a first end, ii) a second end, iii) an interior portion between said first end and said second end, said interior portion thicker than said first end and said second end of said coupling element, iv) said second end comprising a spring-tab arm extending from said second end of said coupling element and terminating in a spring-tab, v) said first end of said coupling element comprising a friction-fitting end structured and arranged to friction-fit into said second end of said cutter module and to linearly slidably engage said second end of said cutter module, without threading or applying torque or twisting to said cutter module, to sheath said first end of said coupling element and wherein said second end of said cutter module abuts said interior portion of said coupling element, vi) said second end of said coupling element structured and arranged to linearly slidably engage said second end of said marker module, without threading or applying torque or twisting to said marker module, to sheath said second end of said coupling element and wherein said second end of said marker module abuts said interior portion of said coupling element, and vii) said spring-tab of said spring-tab arm also structured and arranged to engage said externally accessible through-aperture of said marker module and, when engaged, said spring-tab is externally accessible; and d) wherein said marker module cannot be disengaged from said coupling element until said spring-tab engaged with said externally accessible through-aperture of said marker module is displaced from said externally accessible through-aperture of said marker module.

2. The handheld modular tool according to claim 1 wherein said at least one cutter module comprises at least one user-effected linear actuator structured and arranged to actuate said at least one cutter between an extended position, external to said cutter module, and a retracted position, internal to said cutter module, relative to said at least one cutter module.

3. The handheld modular tool according to claim 2 wherein said cutter comprises a knife blade.

4. The handheld modular tool according to claim 3 wherein said knife blade comprises a snap-off razor blade.

5. The handheld modular tool according to claim 1 further comprising a cap structured and arranged to engage said first end of said marker module to protect the marker.

6. The handheld modular tool according to claim 1 further comprising a connector for attaching said handheld modular tool to an object.

7. The handheld modular tool according to claim 1 wherein said handheld modular tool comprises at least one non-radially symmetrical shape to orient said handheld modular tool in a user's hand.

8. A handheld modular tool system having a cutter and a marker, comprising:

a) at least one cutter structured and arranged to cut;

b) at least one marker structured and arranged to mark;

c) at least one cutter handle structured and arranged to handle said at least one cutter, wherein said at least one cutter handle comprises at least one blade end and at least one first connector end;

d) at least one marker handle structured and arranged to handle said at least one marker, wherein said at least one marker handle comprises at least one marker end and at least one second connector end;

e) at least one coupler structured and arranged to rigidly linearly couple, without threading or applying torque or twisting, said at least one first connector end to said at least one second connector end; and f) at least one releaser structured and arranged to release said at least one coupler;

g) wherein said at least one coupler comprises i) at least one spring-tab extending from a first end of said at least one coupler, and ii) at least one friction-fit coupler on a second end of said at least one coupler, opposite from said at least one spring-tab.

9. The handheld modular tool system according to claim 8 further comprising at least one user-effected linear actuator structured and arranged to actuate said at least one cutter between an extended position, external to said cutter handle, and a retracted position, internal to said cutter handle.

10. The handheld modular tool according to claim 8 wherein said cutter comprises a knife blade.

11. The handheld modular tool system, according to claim 8, wherein said at least one cutter comprises at least one snap-off razor blade.

12. The handheld modular tool system, according to claim 8, wherein said at least one cutter handle comprises at least one cutter replacer structured and arranged to assist replacement of said at least one cutter.

13. The handheld modular tool system, according to claim 8, further comprising at least one clip structured and arranged to assist in clipping said modular tool system to at least one object.

14. The handheld modular tool system, according to claim 8, further comprising at least one cap structured and arranged to cap said at least one marker.

15. The handheld modular tool system, according to claim 8, wherein a) said at least one cutter handle comprises said at least one spring-tab structured and arranged to couple with at least one recess, and b) wherein said at least one marker handle comprises said at least one recess structured and arranged to couple with said at least one spring-tab.

16. The handheld modular tool system, according to claim 8, wherein a) said at least one cutter handle comprises at least one orienter structured and arranged to assist in orienting said at least one cutter in at least one user's hand, and b) said at least one marker handle comprises at least one orienter structured and arranged to assist in orienting said at least one marker in at least one user's hand.

17. A handheld modular tool kit, relating to opening and marking boxes, comprising:

a) at least one modular tool comprising i) at least one first cutter structured and arranged to cut;

ii) at least one first marker structured and arranged to mark;

iii) at least one cutter handle structured and arranged to handle said at least one first cutter, wherein said at least one cutter handle comprises at least one blade end and at least one first connector end;

iv) at least one marker handle structured and arranged to handle said at least one first marker, wherein said at least one marker handle comprises at least one marker end and at least one second connector end;

v) at least one coupler structured and arranged to rigidly linearly couple, without threading or applying torque or twisting, said at least one first connector end to said at least one second connector end; and vi) at least one releaser structured and arranged to release said at least one coupler;

b) at least one second marker structured and arranged to mark;

c) wherein said at least one first marker and said at least one second marker are interchangeable;

d) at least one enclosure structured and arranged to enclose said at least one tool and said at least one second marker; and e) at least one user-effected linear actuator structured and arranged to actuate said at least one cutter between an extended position, external to said cutter handle, and a retracted position, internal to said cutter handle;

f) wherein said at least one coupler comprises i) at least one spring-tab extending from a first end of said at least one coupler, and ii) at least one friction-fit coupler on a second end of said at least one coupler, opposite from said at least one spring-tab.

18. The handheld modular tool kit, according to claim 17, wherein said at least one first marker comprises one of at least one ink marker, at least one highlighter, at least one crayon, or at least one ink pen; and said at least one second marker comprises one of at least one ink marker, at least one highlighter, at least one crayon, or at least one ink pen.

19. The handheld modular tool kit, according to claim 17, further comprising at least one second cutter structured and arranged to cut wherein said at least one first cutter and said at least one second cutter are interchangeable.

* * * * *